United States Patent [19]

Davis

[11] 4,109,559

[45] Aug. 29, 1978

[54] PISTOL STRUCTURE

[76] Inventor: Floyd William Davis, 1320 Florida Ave., Long Beach, Calif. 90802

[21] Appl. No.: 785,438

[22] Filed: Apr. 7, 1977

[51] Int. Cl.[2] ..... F41D 11/02

[52] U.S. Cl. ..... 89/195; 42/71 P; 89/154

[58] Field of Search ..... 42/1 R, 2, 8, 59, 65, 42/71 P; 89/154, 194, 195, 196

[56] References Cited

U.S. PATENT DOCUMENTS

| | | | |
|---|---|---|---|
| 172,243 | 1/1876 | Boardman et al. | 42/65 |
| 3,651,593 | 3/1972 | Clark | 42/59 |
| 4,019,273 | 4/1977 | Kibler | 42/1 R |

*Primary Examiner*—Stephen C. Bentley
*Attorney, Agent, or Firm*—William C. Babcock

[57] ABSTRACT

The invention comprises a recoil operated pistol in which the barrel is positioned below the index finger of the hand. Therefore, when the handle of the pistol is gripped by the hand, the axis of the barrel, and, therefore the axis of recoil, is nearly aligned with the center of mass of the hand, and with the axis of the forearm of the user. In this manner, muzzle rise is eliminated and the velocity of recoil is considerably reduced by the combined inertia of the gun-hand-forearm weapon system. These geometrical and mechanical considerations make it possible for the pistol to be effectively fired as a machine gun, and for its structure to have the lightweight and compact dimensions of a pocket pistol.

4 Claims, 4 Drawing Figures

PISTOL STRUCTURE

BACKGROUND OF THE INVENTION

1. Field of the Invention

Pistol Structure.

2. Description of the Prior Art

In prior art pistols, the barrel axis is disposed a substantial distance above the longitudinal axis of the hand and forearm of the user. As a result the recoil force of the explosion causes the muzzle of the gun to rise making it impossible to effectively fire the gun in full automatic and interfering with rapid fire semi-automatic.

The primary purpose in devising the present invention is to supply a pistol that will overcome these operational disadvantages of prior art pistols.

SUMMARY OF THE INVENTION

The invention comprises an automatic recoil operated pistol of such design that when the handle thereof is gripped, the barrel is nearly axially aligned with the center of mass of the hand and with the axis of the forearm. The pistol includes a spring-loaded breechblock which slidably operates within a breechblock reciprocating space. This reciprocating space is totally compartmented within the handle of the pistol. Within the breechblock is a spring-loaded firing pin which is operated by a hammer and trigger mechanism which are positioned above the axis of the barrel and breechblock reciprocating space. The trigger system of the pistol is also located above the axis of the barrel. The extractor and ejector are located above the axis of the barrel. The extractor and ejector are located on the breechblock in such a manner that the ejection port is located to the left of the pistol. A magazine is located within a magazine space in the handle of the pistol below and rearward of the firing chamber.

DESCRIPTION OF THE PREFERRED EMBODIMENT

Figure 1:
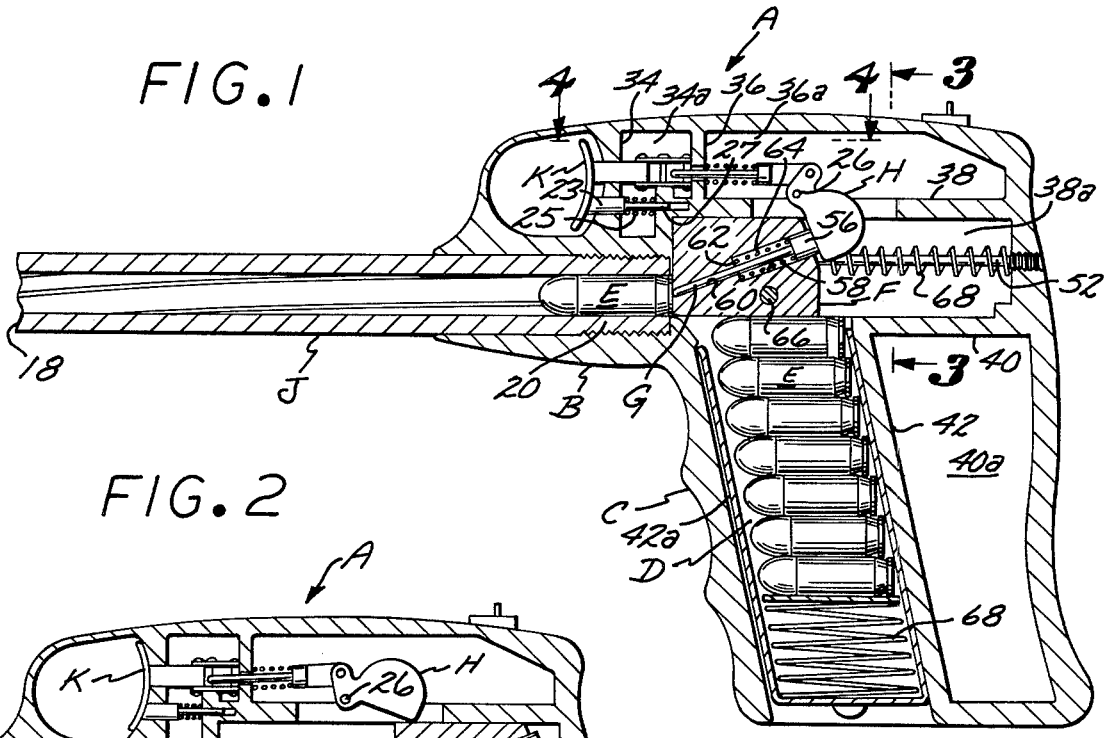
FIG. 1 is a longitudinal cross-sectional view of the pistol, with the bolt in abutting contact with the case of the cartridge that is to be fired, and the trigger just pivoting into a position where it strikes the firing pin.

The automatic recoil operated pistol as may be seen in FIG. 1 includes a frame B that has a hollow handle C in which a magazine clip D of cartridges E may be removably disposed. The frame B movably supports a spring-loaded bolt F, which bolt has a spring-loaded firing pin G mounted thereon. A hammer H is pivotally supported by the frame B, and is adapted to strike the firing pin G when the bolt F is in a firing position. The frame B supports a tubular interiorly rifled barrel J that has a first end 18 and second end 20. the barrel J is so disposed that when the pistol is gripped by the handle C, the axis of the barrel J is nearly aligned with the center of mass of the hand and with the longitudinal axis of the forearm of a user (not shown). As a result of such a geometrical configuration when the pistol A recoils as the cartridges E are fired, the force of the recoil has substantially no turning moment relative to the forearm of the user and has reduced recoil velocity due to the combined inertia of the gun-hand-forearm system.

Figure 4:
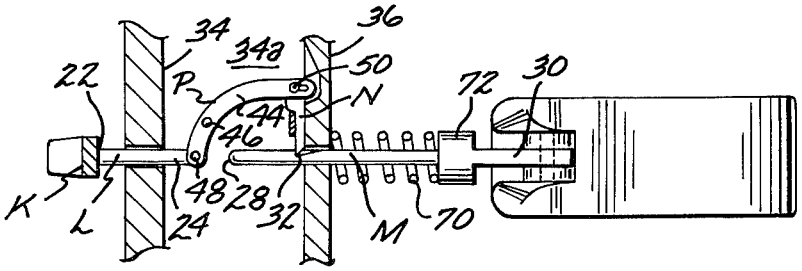
FIG. 4 is a fragmentary top plan view and longitudinal cross-sectional view of the pistol taken on the line 4—4 of FIG. 1.

The pistol A includes a trigger K that is disposed above the barrel J as shown in FIG. 1, and the pistol when fired having the forefinger of the user extending over the rearward portion of the barrel J to engage the trigger. A first rod L as seen in FIG. 4 is provided that has a first end 22 and second end 24. The trigger K is secured to the first end 22 of the first rod L. Also attached to the trigger K is a trigger return rod 23 which is in abutting contact with a trigger return spring 25. The spring 25 which is mounted on the spring guide 27 is also in abutting contact with the frame of the pistol and at all times tends to slidably push the trigger K to its forwardmost position as shown in FIG. 1.

A second rod M is provided that has a first end 28 and second end 30. This second rod M as shown in FIG. 4 has a detent 32 defined therein adjacent to the first end 28 thereof. The frame B includes first, second, third, fourth, and fifth transverse partitions 34, 36, 38, 40 and 42 as shown in FIG. 1 that serve to subdivide the interior of the frame into first, second, third, fourth and fifth confined spaces 34*a*, 36*a*, 38*a*, 40*a*, and 42*a*. A sear N is slidably movable relative to the second partition as shown in FIG. 4 and is actuated by a linkage assembly P, which assembly is connected to the second end of the first rod L. The linkage assembly P includes a lever 44 shown in FIG. 4 that by a first transverse pin 46 is pivotally supported from the frame B. A second pin 48 pivotally connects one end of the lever 44 to the second end portion 24 of the first rod L. A third pin 50 secured to the sear N engages a slot in the lever 44 and pivotally connects the sear N to the lever 44. The sear N when the pistol is not in use will engage the detent 32 as shown in FIG. 4 and the sear when so engaging the detent preventing the hammer H from pivoting to a position where it strikes the firing pin G. The hammer H is pivotally supported on a transverse pin 26 as shown in FIG. 1.

A rod 52 extends forwardly from the frame B in the confined space 38*a* and slidably engages a longitudinally extending bore 54 formed in the bolt F. A compressed helical spring 68 encircles the rod 52 and at all times tends to urge the bolt F forwardly to the firing position shown in FIG. 1 where the hammer H may pivot to forceful contact with the firing pin G. The firing pin G has a head 56 mounted on the rearward end thereof, which head is slidably movable in an elongate cavity 58 defined in the bolt F. A bore 60 extends forwardly in the bolt F from the cavity 58, and serves to slidably support the pin G. The cavity 58 and bore 60 at their junction define a body shoulder 62 as shown in FIG. 1. A helical spring 64 is disposed in the cavity 58 and has one end in abutting contact with the body shoulder 62 and the other end in engagement with the head 56.

When the bolt F moves forwardly in the frame B to the firing position as shown in FIG. 1 as will later be explained, the hammer H pivots clockwise and strikes the head 56 to force the firing pin G forwardly within the bore 60 to contact the detonator cap (not shown) to fire the cartridge E disposed in the rearward breech portion of the barrel J.

A transverse rod 66 is secured to the bolt F and extends outwardly from a longitudinally extending slot (not shown) in the frame B. The rod 66 is used in manually cocking the pistol A to move the bolt F initially from the position shown in FIG. 1 to that illustrated in FIG. 2 to permit a compressed spring 69 to move the uppermost one of the cartridges E in the magazine clip D into a position in the frame B where it is axially aligned with the bore of the barrel J. When the bolt F is moved from the firing position as shown in FIG. 1 to the position shown in FIG. 2 by use of the rod 66, the hammer H is pivoted counterclockwise to the position shown in FIG. 2. When the hammer G is so disposed, the sear N moves into engagement with the detent 32, and the hammer H cannot pivot to strike the firing pin G until the trigger K is moved rearwardly to release the sear N from engagement with the detent 32.

After the pistol A has been cocked as abovedescribed, the pistol is fired by pressing the trigger K to move the same rearwardly and release the sear N from engagement with the detent 32. A compressed helical spring 68 encircles the rod 52 and at all times urges the bolt F into a position shown in FIG. 2. A second compressed helical spring 70 encircles a portion of the second rod M, with one end of the spring in abutting contact with the partition 36 at the opposite end of the spring in engagement with an enlarged portion 72 of the second rod M. Upon the detent 32 being disengaged from the sear N, the compressed spring 70 expands and in so doing the firing pin also forcefully contacting the detonator cap (not shown) to explode the cartridge E situated in the rearward breech portion of the barrel J.

Figure 2:
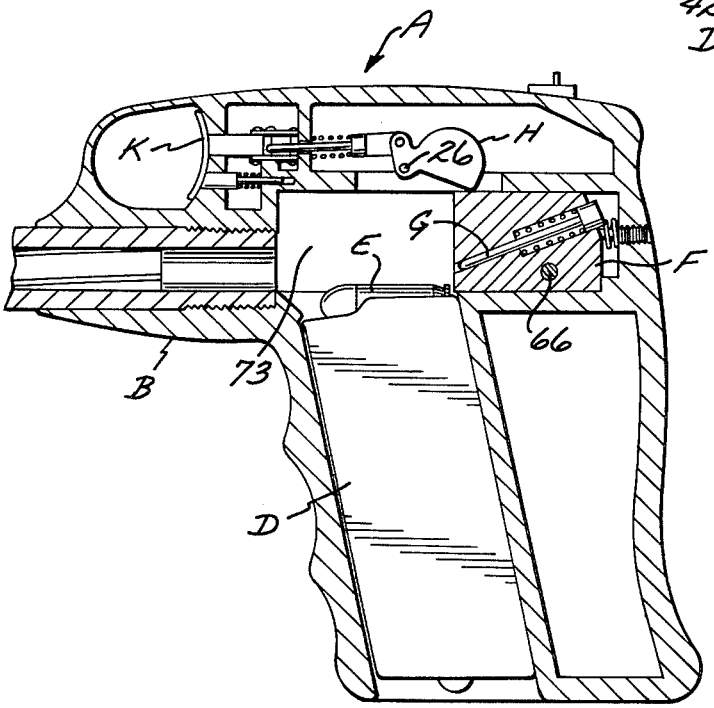
FIG. 2 is the same view as shown in FIG. 1, but with the bolt moving to its rearward-most position after the firing of a cartridge, and the spring-loaded magazine having advanced a cartridge upwardly where it will be engaged by the bolt as the bolt moves forwardly due to spring means to the position shown in FIG. 1.
Figure 3:
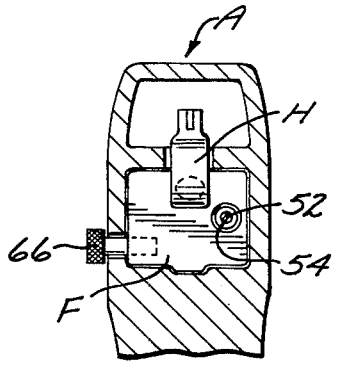
FIG. 3 is a transverse cross-sectional view of a portion of the pistol taken on the line 3—3 of FIG. 1.

As a result of the explosion on the base of the cartridge case a rearwardly directed force is exerted thereon on the base of the cartridge case as well as on the bolt F, to move the case rearwardly where it is ejected through an opening 73 formed in the frame B and the bolt F being moved to the position shown in FIG. 2. As such rearward movement of the bolt F takes place, the hammer H is pivoted counterclockwise to the position shown in FIG. 2. The spring 68 now tends to move the bolt F forwardly, and as the bolt so moves the uppermost one of the cartridges E in the magazine clip D is engaged by the forward end of the bolt and forced into the breech portion of the barrel J as the bolt F moves forwardly. Concurrently with the forward movement of the bolt F, the hammer H pivots clockwise and strikes the head 56 of the firing pin G when the bolt F moves into the firing position shown in FIG. 1. The cartridge E in the breech portion of the barrel J is now fired in the manner previously described, and the above-described operation is successively repeated each time one of the cartridges E is moved from the magazine clip D into a firing position in the breech.

Firing of the cartridges is terminated by relieving pressure on the trigger to allow the sear N to engage the detent 32 and hold the hammer H in a fixed position relative to the frame B.

The use and operation of the invention has been described previously in detail and need not be repeated.

What is claimed is:

1. A pistol that includes a barrel, a housing situated rearwardly of said barrel and extending thereabove, a hollow handle depending from said housing, a spring-loaded cartridge magazine in said handle that at all times urges cartridges in said magazine upwardly, a recoil actuated assembly in said housing that includes a breech block that reciprocates between first and second positions, said breech block when in said first position permitting said spring loaded magazine to move an uppermost one of said cartridges into coaxial alignment with said barrel and when moving towards said second position forcing said uppermost cartridge into said barrel and detonating said uppermost cartridge, said pistol being characterized by a trigger assembly disposed above said barrel and longitudinally movable relative to said housing and so operatively associated with said recoil actuated assembly that when said trigger assembly is moved from a first to a second position, said uppermost cartridge is fired by movement of said breech block to said second position and said trigger assembly so long as it remains in said second position permitting cartridges in said magazine to be sequentially advanced to said firing position to be detonated by said breech block as the latter moves to said second position, said trigger assembly including a trigger disposed above said barrel and forwardly of said housing, which trigger is removably engageable by a forefinger of the hand of a user when the balance of the fingers of said hand encircle said handle and the rearward portions of said housing and handle are cradled in said hand, and the recoil force from said pistol being exerted on substantially the center of the palm if said hand to provide a minimum of leverage, and said pistol due to said minimum leverage having a minimum tendency to pivot upwardly relative to said hand when said pistol is fired.

2. A pistol as defined in claim 1 in which said breech block is disposed in said housing a substantial distance below said trigger assembly.

3. A pistol as defined in claim 2 in which said breech block is substantially coaxially aligned with the center of the palm of said user.

4. A pistol as defined in claim 2 in which said breech block is of minimum weight for the function said breech block performs, and said breech block being substantially coaxially aligned with the longitudinal axis of the forearm of a user when the hand of said user grasps said handle of said pistol.

* * * * *